US010508241B2

(12) United States Patent
Bhattacharya et al.

(10) Patent No.: US 10,508,241 B2
(45) Date of Patent: Dec. 17, 2019

(54) RECOVERY OF HYDROCARBON DILUENT FROM TAILINGS

(71) Applicant: SYNCRUDE CANADA LTD. in trust for the owners of the Syncrude Project as such owners exist now and in the future, Fort McMurray (CA)

(72) Inventors: Sujit Bhattacharya, Edmonton (CA); Barry Bara, Edmonton (CA); Craig A. McKnight, Sherwood Park, CA (US); Daniel John Bulbuc, Sherwood Park, CA (US); George Cymerman, Edmonton (CA)

(73) Assignee: SYNCRUDE CANADA LTD., Fort McMurray (CA), in trust for the owners of the Syncrude Project as such owners exist now and in the future ( * ) Notice: Subject to any disclaimer, the term of this patent is extended or adjusted under 35 U.S.C. 154(b) by 10 days.

(21) Appl. No.: 15/614,381

(22) Filed: Jun. 5, 2017

(65) Prior Publication Data

US 2018/0346818 A1 Dec. 6, 2018

(51) Int. Cl.
*C10G 1/04* (2006.01)

(52) U.S. Cl.
CPC ..... *C10G 1/04* (2013.01)

(58) Field of Classification Search
CPC ..... C10G 1/04; C10G 1/02
See application file for complete search history.

(56) References Cited

U.S. PATENT DOCUMENTS

| | | | | |
|---|---|---|---|---|
| 4,545,892 | A | 10/1985 | Cymbalisty et al. | |
| 6,746,599 | B2 | 6/2004 | Cymerman et al. | |
| 9,314,713 | B2 * | 4/2016 | Moran | B01D 17/0205 |
| 9,676,684 | B2 * | 6/2017 | Duerr | C10G 1/04 |
| 2010/0126906 | A1 | 5/2010 | Sury | |
| 2011/0278202 | A1 | 11/2011 | Moran et al. | |
| 2012/0247944 | A1 * | 10/2012 | Milani | B01D 1/04 203/92 |

FOREIGN PATENT DOCUMENTS

| | | | |
|---|---|---|---|
| CA | 1027501 | A | 3/1978 |
| CA | 2173559 | A1 | 10/1996 |
| CA | 2272035 | A1 | 11/2000 |
| CA | 2272045 | A1 | 11/2000 |
| CA | 2353109 | A1 | 1/2003 |
| CA | 2454942 | A1 | 7/2005 |
| CA | 2587166 | A1 | 9/2007 |
| CA | 2665704 | A1 | 11/2010 |
| CA | 2712725 | A1 | 11/2011 |
| CA | 2768852 | A1 | 11/2011 |
| CA | 2911272 | A1 | 5/2016 |

* cited by examiner

*Primary Examiner* — Randy Boyer
*Assistant Examiner* — Juan C Valencia
(74) *Attorney, Agent, or Firm* — Bennett Jones LLP

(57) ABSTRACT

A method for recovering hydrocarbon diluent from tailings comprising bitumen, particulate solids, hydrocarbon diluent and water, is provided comprising introducing the tailings into a high pressure stripping vessel operating at a pressure greater than 100 kPa; and introducing a stripping gas into the high pressure stripping vessel to strip the hydrocarbon diluent and water from the tailings and form a stripped tailings pool at the bottom of the vessel.

15 Claims, 6 Drawing Sheets

RECOVERY OF HYDROCARBON DILUENT FROM TAILINGS

FIELD OF THE INVENTION

The present invention relates to a method for recovery of a hydrocarbon diluent from a slurry or tailings such as froth treatment tailings produced in a bitumen froth treatment plant. More particularly, hydrocarbon diluent is removed from the tailings in a high pressure stripping vessel that is operated at above-atmospheric pressure.

BACKGROUND OF THE INVENTION

Oil sand, as known in the Fort McMurray region of Alberta, Canada, comprises water-wet sand grains having viscous bitumen flecks trapped between the grains. The oil sand lends itself to separating or dispersing the bitumen from the sand grains by slurrying the as-mined oil sand in water so that the bitumen flecks move into the aqueous phase.

For the past 25 years, the bitumen in McMurray oil sand has been commercially recovered using a hot/warm water process. In general, the process involves slurrying oil sand with heated water, optionally, a process aid such as caustic (NaOH) and naturally entrained air. The slurry is mixed, commonly in tumblers, for a prescribed retention time to initiate a preliminary separation or dispersal of the bitumen and the solids and to induce air bubbles to contact and aerate the bitumen. The conditioned slurry is then subjected to flotation to further separate the bitumen from the sand.

A recent development in the recovery of bitumen from oil sand involves a low temperature process whereby the oil sand is mixed with heated water directly at the mine site to produce a pumpable, dense, low temperature slurry. The slurry is then pumped through a pipeline to condition the slurry for flotation. It is understood, however, that other bitumen extraction processes exist, each producing conditioned oil sand slurry.

Conditioned oil sand slurry may be further diluted with flood water and introduced into a large, open-topped, conical-bottomed, cylindrical vessel (termed a primary separation vessel or "PSV"). The diluted slurry is retained in the PSV under quiescent conditions for a prescribed retention period. During this period, the aerated bitumen rises and forms a froth layer, which overflows the top lip of the vessel and is conveyed away in a launder. The sand grains sink and are concentrated in the conical bottom. They leave the bottom of the vessel as a wet tailings stream. Middlings, a watery mixture containing solids and bitumen, extend between the froth and sand layers.

The wet tailings and middlings are withdrawn and may be combined for further processing in a secondary flotation process. This secondary flotation process is commonly carried out in a deep cone vessel wherein air is sparged into the vessel to assist with flotation. This vessel is referred to as the TOR vessel. It and the process conducted in it are disclosed in U.S. Pat. No. 4,545,892, incorporated herein by reference. The bitumen recovered by the TOR vessel is recycled to the PSV. The middlings from the deep cone vessel are further processed in air flotation cells to recover contained bitumen.

The froths produced by these units are generally combined and subjected to further processing. More particularly, it is conventional to dilute the bitumen froth with a light hydrocarbon diluent, such as naphtha or a paraffinic diluent, to first improve the difference in specific gravity between the bitumen and water and to reduce the bitumen viscosity, to aid in the separation of the water and solids from the bitumen. Separation of the bitumen from water and solids is commonly achieved by treating the diluent diluted froth in a sequence of inclined plate settlers, scroll and disc centrifuges, and the like. Other processes for separating solids and water from diluted bitumen froth are known in the art and include stationary froth treatment (SFT) as described in U.S. Pat. No. 6,746,599, incorporated herein by reference.

The primarily water and solids fraction obtained after separation is commonly referred to as froth treatment tailings. Paraffinic froth treatment tailings typically comprise water, asphaltenes, fines solids, bitumen and about 5010 wt % residual paraffinic solvent. Naphthenic froth tailings typically comprise water, fines solids, residual bitumen and about 2-4 wt % naphtha. It is desirable both economically and environmentally to recover the hydrocarbon diluent from the tailings prior to disposal of the tailings. However, the unique nature of the diluent-containing tailings makes diluent removal a challenge to the industry. In particular, it is believed that some of the diluent is intimately associated with the solids, making diluent removal from the solids more difficult.

Canadian Patent No. 1,027,501 discloses a process for treatment of centrifuge tailings to recover naphtha. The process comprises introducing the tailings into a vacuum flash vessel maintained at vacuum conditions (e.g., about 35 kPa) in order to flash the naphtha present in the tailings. The vessel is also equipped with a plurality of shed decks so that any residual naphtha remaining in the tailings stream will be vaporized by the introduction of steam beneath these shed decks. In practice, however, this process results in only 60 to 65% recovery of the diluent, as the vacuum at the tailings feed inlet of the vessel may have resulted in the tailings bypassing the shed decks and pooling near the bottom of the vessel. In the alternative, or additionally, the reduction in pressure in the tower to below atmospheric resulted in steam condensation and reduced heat transfer to the slurry. Thus, the pooled tailings at the bottom of the vessel still contained a substantially large amount of diluent. Canadian Patent No. 2,272,035 partially addressed this issue by introducing the steam into the tailings pool for vaporizing the residual diluent pooling near the bottom of the vessel.

Canadian Patent No. 2,272,045 discloses a method for recovery of hydrocarbon diluent from tailings produced in a bitumen froth treatment plant comprising introducing the tailings into a steam stripping vessel maintained at near atmospheric pressure (e.g. around 95 kPa) in an attempt to avoid the problem of the tailings bypassing the shed decks. Without a vacuum, vessel pressure increased to atmospheric, or slightly above, and temperature increased to around 100° C. This resulted in increased steam to slurry heat transfer, greater steam flowrate to the condenser and consequently increased naphtha recovery. The operating temperature of the vessel was preferably maintained at approximately 100° C.

However, while operating a steam stripping vessel for recovery of hydrocarbon diluent from tailings produced in a bitumen froth treatment plant at about 100° C. and at near atmospheric pressure significantly improved diluent recovery over previous operations at below atmospheric pressure, there still was a substantial amount of diluent remaining in the tailings pool. As stated in Canadian Patent No. 2,272,045, operating the vessel at near atmospheric pressure and at a steam to tailings ratio of approximately 9.0 wt. % increased the naphtha recovery to only about 80%.

SUMMARY OF THE INVENTION

In one aspect of the present invention, a method for recovering hydrocarbon diluent from tailings is provided comprising introducing the hydrocarbon diluent containing tailings (feed tailings) into a steam stripping vessel operating at above-atmospheric pressure (hereinafter referred to as a "high pressure stripping vessel"). In one embodiment, the high pressure stripping vessel is operated at a pressure of between 100-200 kPa. Because of the high pressure conditions, the temperature in the high pressure stripping vessel is generally above 100° C., thereby producing high temperature or hot tailings, which pool at the bottom of the high pressure stripping vessel. As used herein, "high temperature tailings" or "hot tailings" mean tailings produced in the tailings pool of a high pressure stripping vessel which have a temperature that is higher than the temperature of the feed tailings. In general, the high temperature tailings will have a temperature of between about 100° C. to about 120° C. In one embodiment, the stripping gas used in the high pressure stripping vessel is steam. In one embodiment, a portion of the tailings pool formed in the high pressure stripping vessel is recycled back to the stripping vessel.

In another aspect of the present invention, both a high pressure stripping vessel, operating at a pressure of between 100-200 kPa, and a low pressure flash vessel operating at a pressure below 100 kPa, are used to recover hydrocarbon diluent from hydrocarbon diluent containing tailings. Thus, a method for recovering hydrocarbon diluent from tailings is provided, comprising:

- introducing the tailings into a high pressure stripping vessel operating at a pressure greater than 100 kPa such that a stripped tailings pool is formed at the bottom of the high pressure stripping vessel and hydrocarbon diluent and water vapors are formed and released from the top of the high pressure stripping vessel;
- introducing steam into the high pressure stripping vessel either above the stripped tailings pool or into the stripped tailings pool or both; and
- removing a portion of high temperature stripped tailings from the stripped tailings pool and introducing the portion of high temperature stripped tailings to a low pressure flash vessel operating at a pressure below 100 kPa to remove additional hydrocarbon diluent from the portion of high temperature stripped tailings.

In one embodiment, the high pressure stripping vessel comprises a stack of internal, vertically and laterally spaced shed decks and the tailings are introduced into the vessel such that the tailings are distributed over at least some of the shed decks. In this embodiment, the steam is introduced below the shed decks but above the stripped tailings pool. In one embodiment, the steam is introduced into the stripped tailings pool. In one embodiment, steam is introduced both below the shed decks but above the stripped tailings pool and into the tailings pool. In another embodiment the shed decks are arranged in vertical sections with a portion of the feed and/or steam introduced in between sections.

In one embodiment, the tailings are introduced into the stripping vessel by injecting the tailings into the stripped tailings pool. In another embodiment, tailings are introduced into the stripped tailings pool, in between a stack of shed decks and directly above a stack of shed decks.

In one embodiment, a portion of the stripped tailings pool is recycled back to the high pressure stripping vessel.

In one embodiment, the hydrocarbon diluent containing tailings are first separated into a fine solids tailings slurry and a coarse solids tailings slurry. As used herein, "fine solids" or "fines" refers generally to clays and silts having a particle size (diameter) of less than 44 microns. As used herein, "coarse solids" refers generally to sand having a particle size (diameter) greater than 44 microns.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF THE PREFERRED EMBODIMENT

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
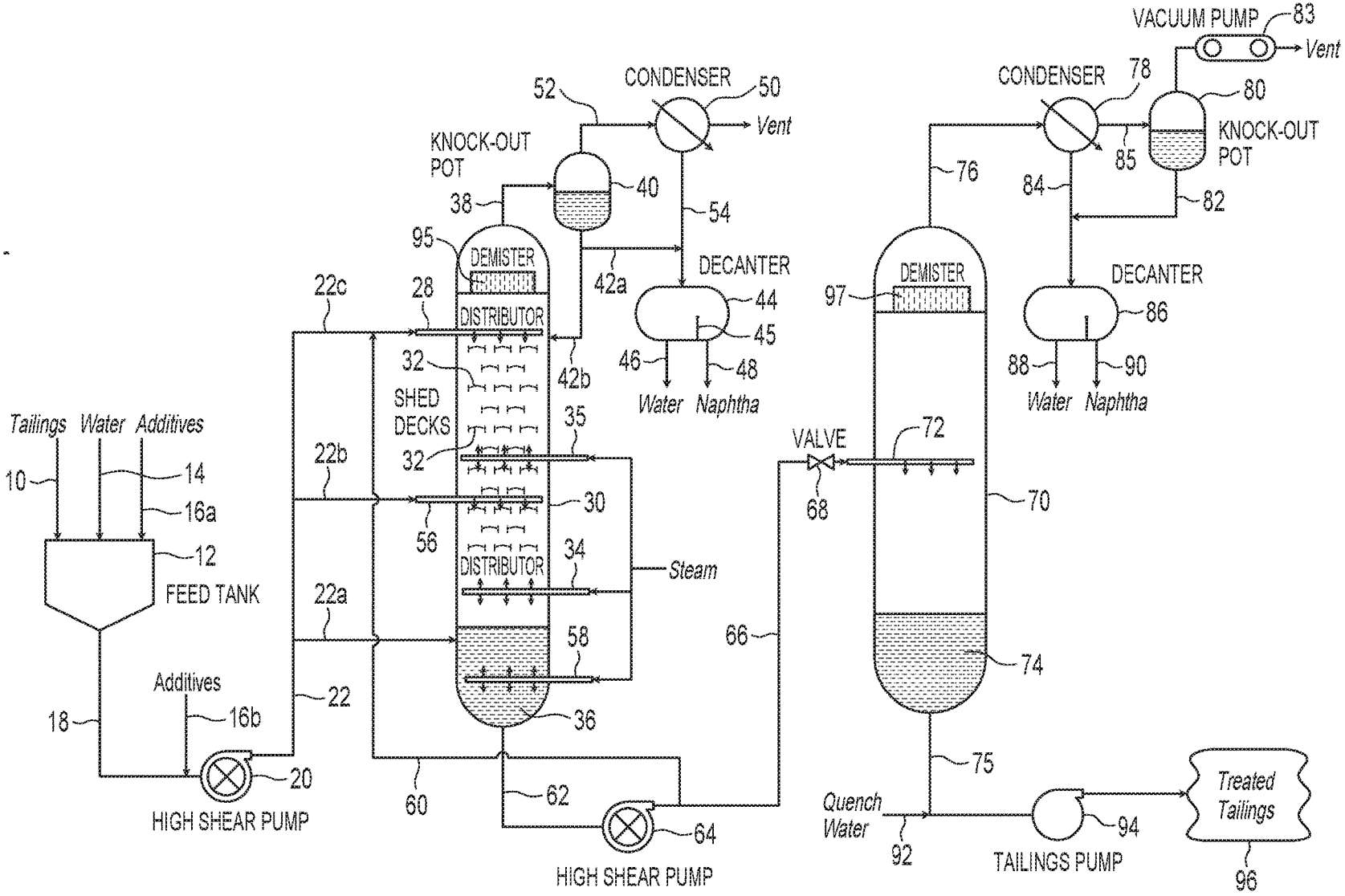
FIG. 1 is a schematic showing one embodiment of a hydrocarbon diluent extraction circuit useful in the present invention.

One embodiment of the present method for hydrocarbon diluent recovery from froth treatment tailings can be best described with reference to FIG. 1. Froth treatment tailings 10 are initially housed in feed tank 12 where additional water 14 may or may not be added. Optionally, process additives 16*a*, 16*b* can be added to the tailings either into the feed tank 12 or to the stream of tailings 18 which is removed from the feed tank 12, respectively, for further processing. Additives may include surfactants, defoaming agents, emulsifiers and the like which are added to break up any hydrocarbon/diluent lumps which may be present in the tailings. For example, when naphtha is used as the hydrocarbon diluent, the naphtha may mix with the residual hydrocarbon present in the tailings and form hydrocarbon/naphtha lumps.

Tailings stream 18 is then, optionally, pumped through a high shear pump 20, where further break-up of hydrocarbon/diluent lumps may occur. The sheared tailings 22 are then fed into a high pressure steam stripping vessel 30 at various locations, i.e., as tailings streams 22*a*, 22*b* and/or 22*c*, which is discussed in more detail below. The high pressure stripping vessel 30 is maintained at a pressure above atmospheric pressure, preferably, between about 100 kPa to about 200 kPa, however, it is understood that higher than 200 kPa could be used.

In one embodiment, sheared tailings stream 22*c* is introduced into vessel 30 via a feed box distributor 28 having a plurality of openings and which is located near the top of the vessel 30. Directly below the distributor 28 is a series of shed decks 32. The distributor 28 functions to evenly distribute the feed (i.e. tailings) over the series of shed decks 32. The shed decks 32 ensure that the tailings are spread over a large surface area that can subsequently be exposed to steam. Shed decks are inherently less efficient in mass transfer between the gas and liquid phases than other types of internals typically used in stripping vessels such as sieve trays, packed beds, etc. However, due to the high concentration of coarse solids present in the feed slurry, the more open and, therefore, less fouling structure of shed decks is required.

Directly below the shed decks 32 is a steam ring 34 having a plurality of openings for the release of steam. The steam counter currently contacts the tailings distributed over the shed decks 32 and provides heat for vaporizing the hydrocarbon diluent and a portion of the water contained in the tailings. In one embodiment, a second steam ring 35 can be positioned between the stacks of shed decks 32 to ensure that the tailings on the uppers are sufficiently contacted with steam as well. The diluent-stripped feed settles to the bottom of the vessel and forms a stripped tailings pool 36.

The vaporized diluent and water is removed from vessel 30 as vapor stream 38 and is then introduced into a knock-out pot 40, which is a vapor-liquid separator. The vapor product 52, which comprises primarily hydrocarbon diluent, can then be passed through a condenser-cooler 50, where it is cooled and forms liquid product 54. The liquid product 42 from knock-out pot 40, which comprises primarily water, and the liquid product 54 are combined and introduced into decanter 44, where water 46 and diluent 48 are separated, for example, by using a weir 45 such that the naphtha overflows into a separate compartment. The liquid product from the knockout pot 40 may contain entrained solids and may alternatively sent back to the feed section of the high pressure stripping vessel via conduit 42*b* or be sent straight to the decanter 44 via conduit 42*a*. Diluent 48 produced in decanter 44 can be reused and water 46 can be recycled back to the feed tank 12.

In one embodiment, sheared tailings stream 22*b* can be introduced into vessel 30 via a second feed box distributor 56 having a plurality of openings and located near the middle of the vessel 30. Directly below the distributor 28 are a portion of shed decks 32. The distributor 56 also functions to evenly distribute the feed (i.e. tailings) over the portion of shed decks 32 below distributor 56. As previously mentioned, the shed decks 32 ensure that the tailings are spread over a large surface area that can subsequently be exposed to steam.

In one embodiment, sheared tailings stream 22*a* can be introduced directly into the stripped tailings pool 36. In this embodiment, steam 58 is also injected directly into the stripped tailings pool 36. It is understood that sheared tailings 22 can be introduced in either one, two or three injection sites, i.e., as stream 22*a*, 22*b*, and/or 22*c* and steam can be injected either directly below the sheds 32 or into the stripped tailings pool 36 or both, and/or between shed deck sections.

In one embodiment, a portion of the stripped tailings pool 36 can be removed as tailings stream 62 and, optionally, sheared in high shear pump 64 to form tailings stream 66. Tailings stream 66 is then introduced into a second vessel which is a low pressure flash vessel 70, operating below atmospheric pressure, e.g., below about 100 kPa. The portion of the stripped tailings pool, i.e., tailings stream 62, may still have a significant amount of hydrocarbon diluent associated therewith (in addition to water) and by introducing these hot tailings into a low pressure flash vessel, additional hydrocarbon diluent and water can be removed (flashed) from the tailings as vaporized hydrocarbon diluent and water.

A throttling valve 68 (or an orifice) is needed at the low pressure flash vessel inlet to maintain elevated pressure in the feed pipe in order to prevent flash evaporation in the pipe and to control pressure drop at varying tailings feed rates.

The vaporized hydrocarbon diluent (and water) is removed from the top of low pressure flash vessel 70 as stream 76. Stream 76 is passed through condenser-cooler 50, where it is cooled and forms liquid product 84 and vapor product 85. The vapor product 85 is then introduced into knock-out pot 80, where liquid diluent/water is separated to form liquid stream 82. Liquid stream 82 from knock-out pot 80 and the liquid product 84 are combined and introduced into decanter 86, where water 88 and diluent 90 are separated, i.e., the water settles to the bottom of decanter 86 and the diluent floats to the top of decanter 86. Diluent 90 can be reused and water 88 can be recycled back to the feed tank 12. Gases from the knock-out pot 80 are sent to a vacuum pump 83 which draws gases at a sufficient rate to keep vessel 70 under the desired low pressure.

Cleaned tailings 74, which form a pool at the bottom of low pressure flash vessel 70, are removed from the bottom of low pressure flash vessel 70 as tailings stream 75 and, optionally, quenched with quench water 92 before being pumping via pump 94 to a designated disposal site 96.

In one embodiment, the portion of the stripped tailings pool 36 removed as tailings stream 62 and, optionally, sheared in high shear pump 64 can be recycled as stream 60 and introduced in either one, two or three injection sites, i.e., as stream 22*a*, 22*b*, and/or 22*c* for further stripping with steam. In a preferred embodiment, tailings stream 60 is returned to high pressure stripping vessel 30 via distributor 28 for further contact with sheds 32 and subjected to further steam stripping.

It is understood that additional elements can be present in both high pressure stripping vessel 30 and low pressure flash vessel 70, for example, each vessel can further comprise a demister 95, 97, respectively, located at or near the top of the vessels. Demisters 95, 97 will remove suspended slurry droplets from the vaporized hydrocarbon diluent and water.

Because the high pressure stripping vessel is operated at a pressure above atmospheric pressure, the tailings in the stripped tailings pool have a much higher temperature than the feed tailings (referred to herein as "hot tailings", i.e., tailings having a temperature of greater than about 100° C.). Thus, when hot tailings ($T_1$ above 100° C.) having an elevated pressure ($P_1$ greater than 100 kPa) are delivered to a low pressure flash vessel, which is operating at a lower temperature ($T_2$ less than 100° C.) and a lower pressure ($P_2$ less than 100 kPa), the residual hydrocarbon diluent in the tailings will vaporize (flash) in the low pressure flash vessel. The rate of flash evaporation was found to be directly related to the temperature drop, $\Delta T$, where $\Delta T = T_1 - T_2$. It was further discovered that hydrocarbon diluent concentrations in the vapor phase in the low pressure flash vessel was related to the equilibrium conditions at $T_2/P_2$ and the hydrocarbon diluent concentration in feed tailings.

Figure 2A:
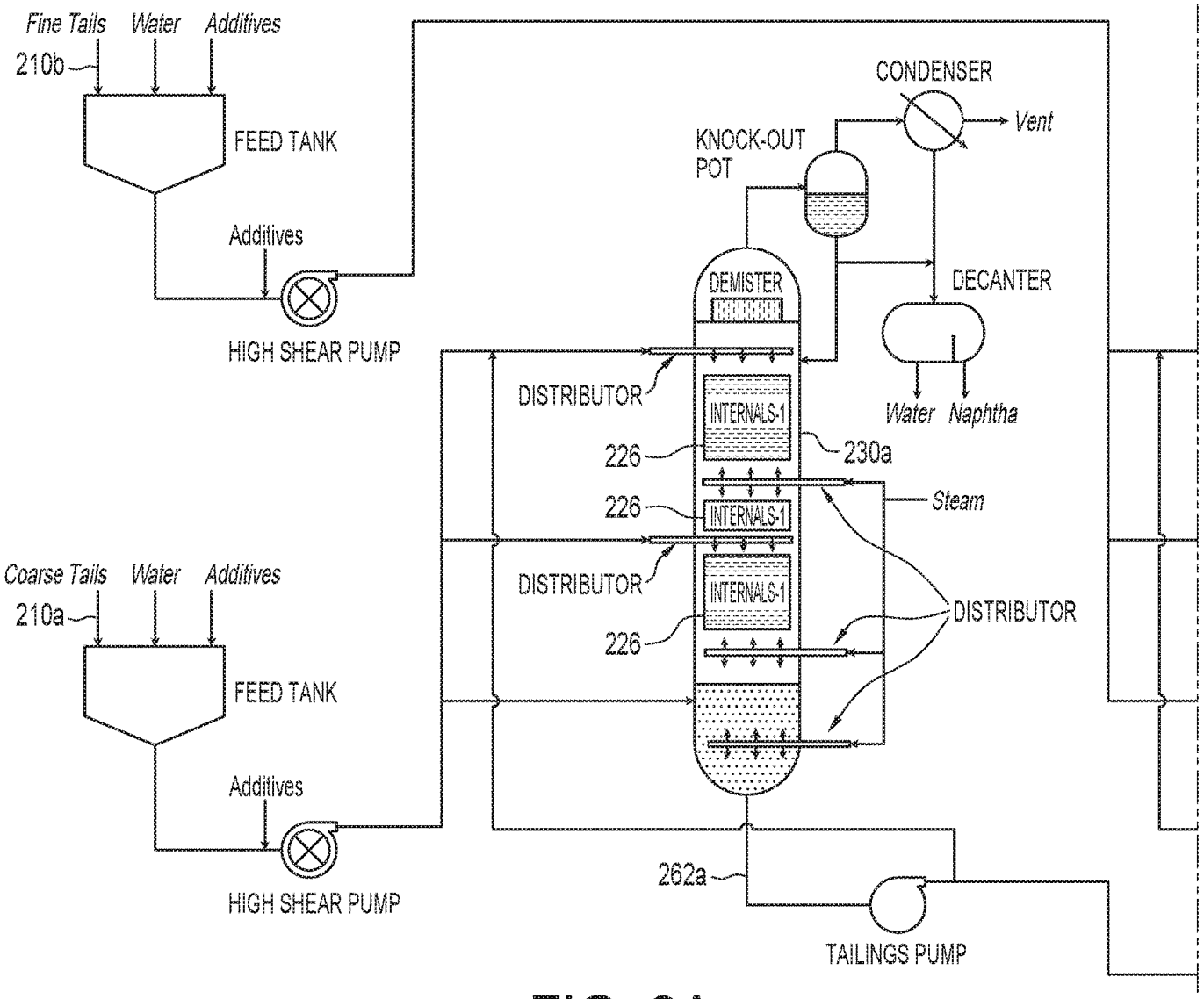
FIGS. 2A and 2B are schematics showing another embodiment of a hydrocarbon diluent extraction circuit useful in the present invention.
Figure 2B:
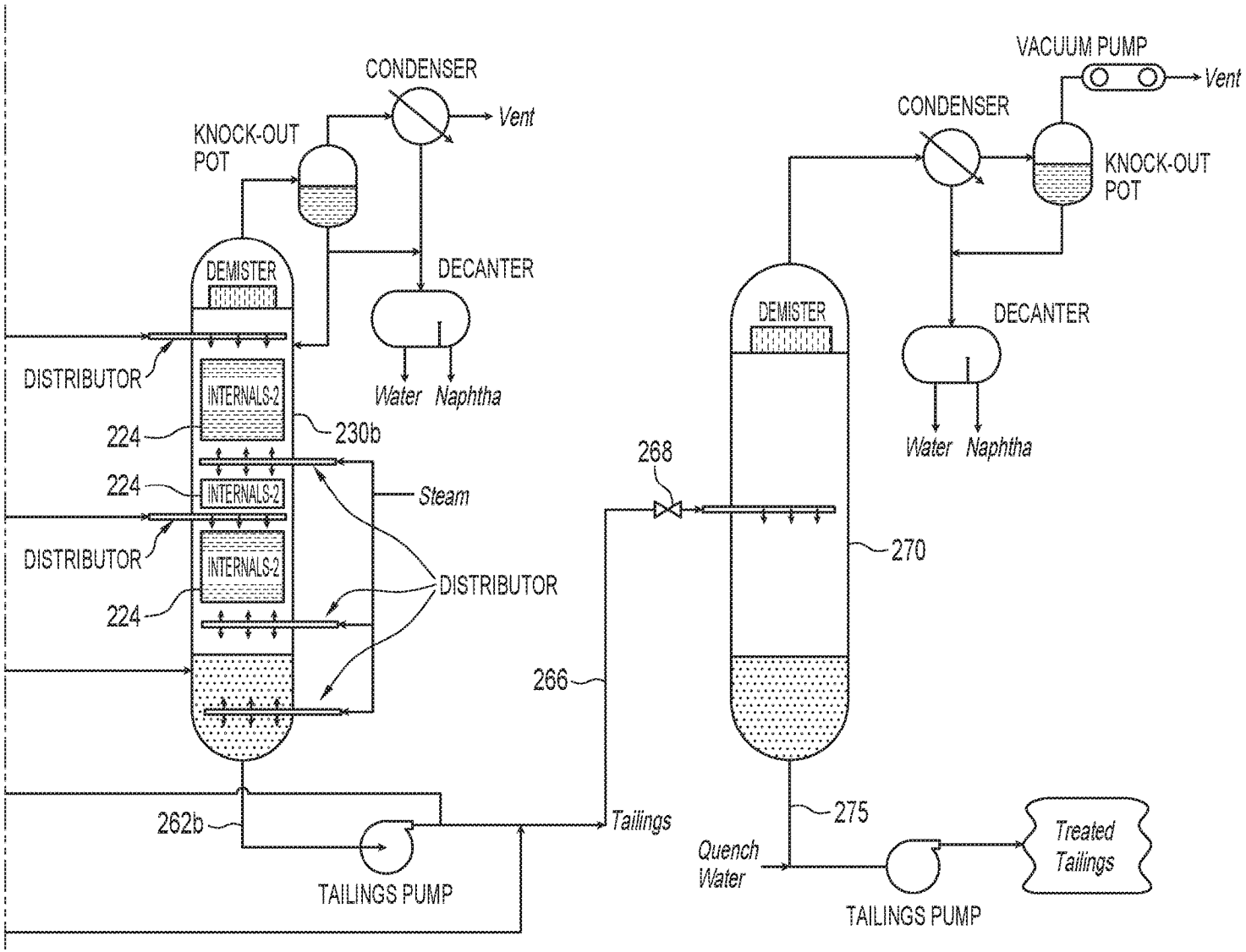

FIGS. 2A and 2B show another embodiment of the present invention. In this embodiment, the solvent containing tailings slurry from the Froth Treatment Unit (FTU) can be separated into two slurries; a coarse tailings slurry 210*a* and a fine solids slurry 210*b*. This separation can be achieved outside the FTU by means of additional equipment such as hydrocyclones or centrifuges or the coarse and fine slurry streams can be piped separately from the FTU, where they are typically generated separately without mixing into each other. Each stream (210*a* and 210*b*) is then individually treated in a high pressure stripping vessel as shown in FIGS. 2A and 2B.

Because the slurry with fine solids, 210*b*, is inherently less fouling, the internals 224 of the high pressure stripping vessel treating this stream, vessel 230*b*, can be chosen to maximize mass transfer. Thus, the high vessel pressure vessel 230*a* treating the slurry with coarser particles, 210*a*, comprises internals 226 which have more open area for slurry and vapors to flow and are less sensitive to fouling, such as shed decks. On the other hand, the high pressure stripping vessel 230*b* treating the slurry with finer or less concentration of solids 210*b* can use internals 224 which have a more restricted flow area and, thus, the transfer of solvent between slurry and vapor phases is more efficient, such as trays or packings.

The pressure and temperature conditions will typically be kept the same in both vessels 230*a* and 230*b* by using the same amount of steam to feed slurry mass flow rate, however, it is understood that each vessel could be individually maintained at different temperature and pressure conditions, if so required. The hot, high pressure tailings 262*a* and 262*b* from the two columns may be combined and the combined hot tailings 266 can be fed into a common low pressure vessel 270 through a pressure reducing device such as a valve 268. As previously stated, the pressure let down will cause some or all of the solvent in the tailings stream 266 to vaporize (flash) thereby further reducing the solvent concentration in the final treated tailings 275 which are then disposed. In this embodiment, by treating part of the slurry feed in a more efficient manner the overall recovery of solvent may be increased.

EXAMPLE 1

Figure 3:
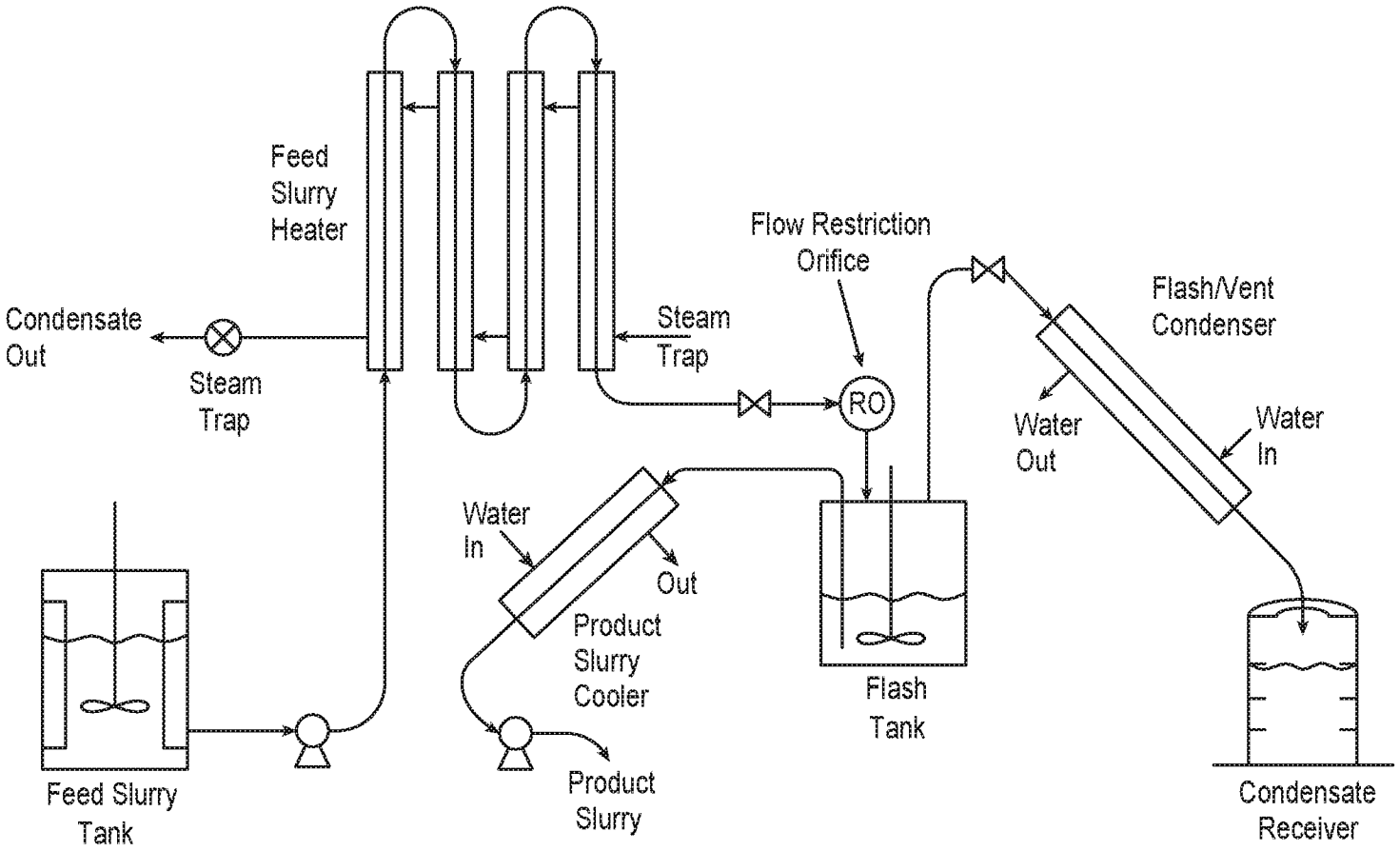
FIG. 3 is a schematic of the continuous flash evaporation pilot used in the experiments described below.

Continuous batch testing was used to investigate the kinetics of hydrocarbon diluent removal from tailings by flashing. A number of tailings were tested having a broad range of residual hydrocarbon diluent. In these experiments, the hydrocarbon diluent was naphtha. A schematic of the continuous flash evaporation pilot used is shown in FIG. 3.

Figure 4:
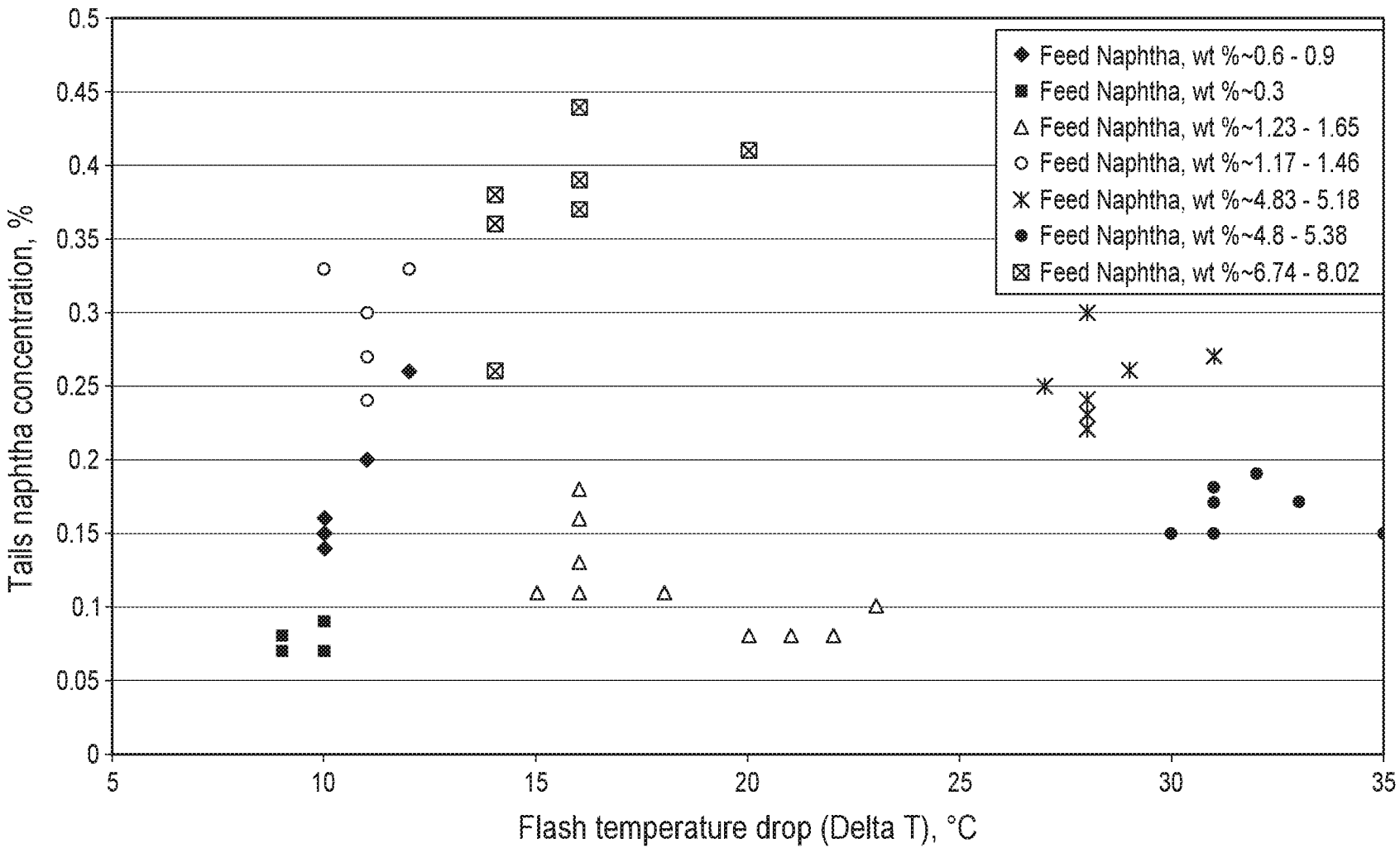
FIG. 4 is a graph showing the wt. % naphtha concentration in tailings after flashing as a function of flash temperature drop ($\Delta T$) in ° C.

The naphtha concentration in the tailings tested ranged from as low as ~0.6-0.9 wt. % to as high as ~6.74-8.02 wt. %. FIG. 4 shows the naphtha concentrations in the tailings after flash as a function of flash temperature drop (ΔT). As shown, feed naphtha concentration in the tailings greatly affects naphtha concentrations in the tailings after flashing. At any given ΔT value, the higher the naphtha concentration in the feed tailings, the higher the naphtha concentration in the final tailings. However, at ΔT values of 30 to 35° C., even with feed tailings naphtha concentrations as high as 5.38 wt. %, the amount of naphtha in the flashed tailings was reduced to <0.2% in a single-stage flash. For feed samples with naphtha concentrations ranging from 1.23 to 1.65 wt. %, flash at ΔT values between 10 and 15 resulted in a final naphtha concentration in the flashed tailings of below 0.3 wt. %. At ΔT values between 20 and 25, naphtha concentration after flash dropped to <0.1 wt. %. The tailings sample with a naphtha concentration of ~0.3 wt. %, required only a small ΔT value of <10° C. to produce tailings with naphtha concentrations below 0.1 wt. %.

Figure 5:
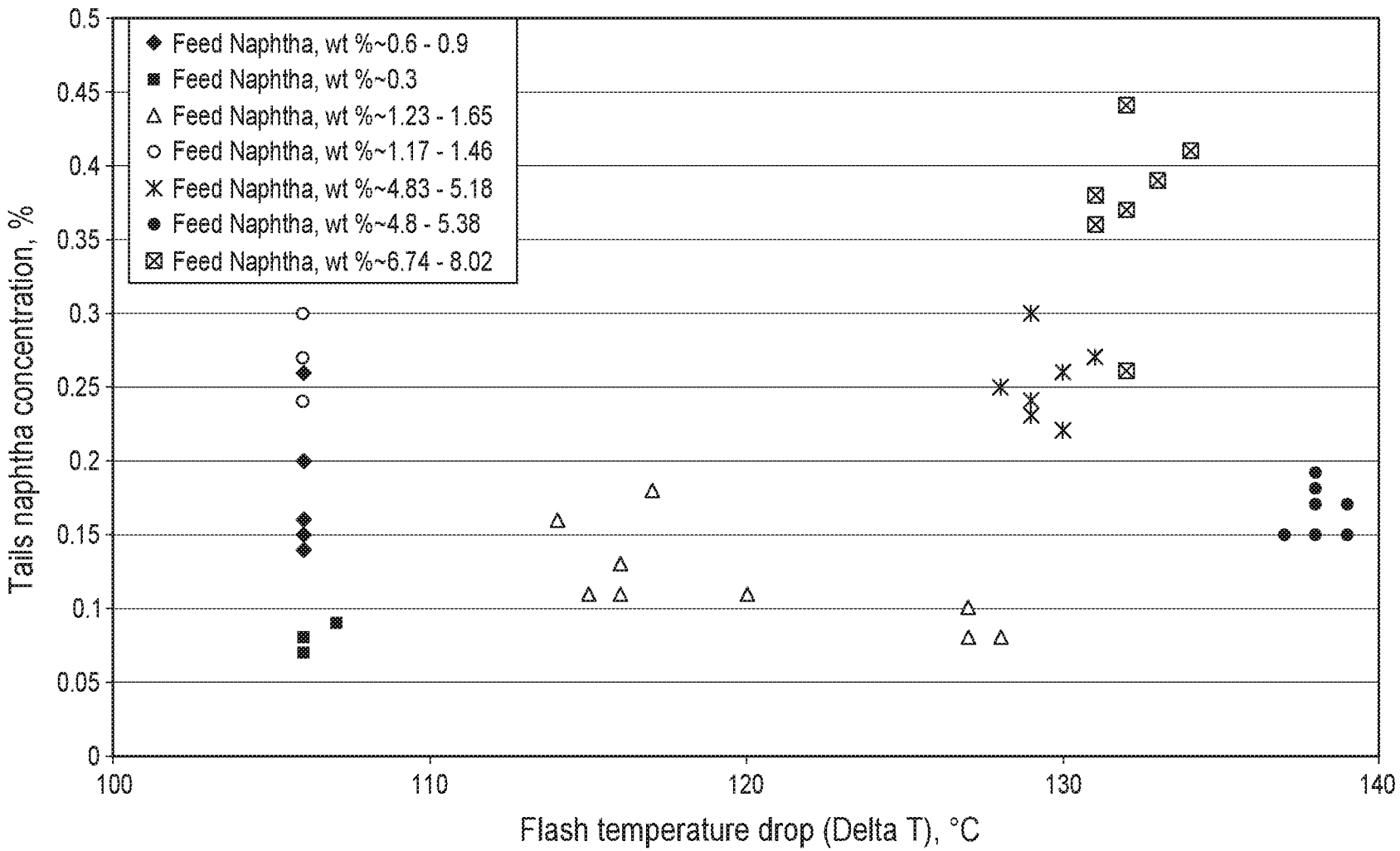
FIG. 5 a graph showing the wt. % naphtha concentration in tailings after flashing as a function of temperature of the tailings before flashing ($T_1$) in ° C.

FIG. 5 shows naphtha concentrations in flashed tailings as a function of the temperature of the feed tailings temperature (T1). As shown, in general, the higher the temperature of the feed tailings entering the flash vessel, the lower the amount of naphtha in the flashed tailings. However, the results in FIG. 5 still shows that the naphtha concentration in the feed tailings still affects the naphtha concentrations in the flashed tailings.

Based on the continuous pilot test results, it was discovered that flash evaporation is suitable for naphtha recovery from tailings having a wide range of residual naphtha. To reduce the final tailings naphtha concentrations below 0.1 wt. %, feed tailings with high naphtha concentrations require correspondingly higher ΔT values. For feed tailings having an initial naphtha concentration of ~0.3 wt. %, a relatively low flash ΔT of 10° C. (e.g., from 106° C. to 96° C.) was sufficient to reduce tailings naphtha concentrations to <0.1%. Thus, in one embodiment, feed tailings from a tailings pool of a high pressure stripping vessel can be pumped to a flash tank, where tailings pressure will be letdown from ~105° C.@1.2 bar absolute in the feed pipeline to 0.6 bar absolute in the flash tank resulting in a temperature of about 85° C.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed:

1. A method for recovering hydrocarbon diluent from tailings comprising bitumen, particulate solids, hydrocarbon diluent and water, the method comprising:

providing a high pressure stripping vessel operating at a pressure greater than 100 kPa, the high pressure stripping vessel having internal, vertically and laterally spaced shed decks in its upper portion and a deck-free bottom portion where a tailings pool forms;

introducing a portion of the tailings into the high pressure stripping vessel above the shed decks or in between the shed decks or both, and a portion of the tailings into the tailings pool formed in the high pressure stripping vessel; and introducing a stripping gas into the high pressure stripping vessel below the shed decks but above the tailings pool or in between the shed decks or both, and into the tailings pool formed in the high pressure stripping vessel to strip the hydrocarbon diluent and water from the tailings.

2. The method as claimed in claim 1, wherein the stripping gas is steam.

3. The method as claimed in claim 1 further comprising removing a portion of the tailings from the tailings pool and recycling the portion of tailings back to the high pressure stripping vessel.

4. The method as claimed in claim 1, wherein the pressure in the high pressure stripping vessel is between 100-200 kPa.

5. A method for recovering hydrocarbon diluent from tailings comprising bitumen, particulate solids, hydrocarbon diluent and water, the method comprising:

introducing the tailings into a high pressure stripping vessel operating at a pressure greater than 100 kPa such that a stripped tailings pool is formed at the bottom of the high pressure stripping vessel and hydrocarbon diluent and water is removed from the top of the high pressure stripping vessel;

introducing steam into the high pressure stripping vessel either above the stripped tailings pool or into the stripped tailings pool or both; and removing a portion of high temperature stripped tailings from the stripped tailings pool and introducing the portion of high temperature stripped tailings into a low pressure flash vessel operating at a pressure below 100 kPa to remove additional hydrocarbon diluent from the portion of high temperature stripped tailings.

6. The method as claimed in claim 5, wherein the high pressure stripping vessel comprises a stack of internal, vertically and laterally spaced shed decks and the tailings are introduced into the vessel such that the tailings are distributed over at least some of the shed decks.

7. The method as claimed in claim 6, wherein the steam is introduced below the shed decks but above the stripped tailings pool.

8. The method of claim 6, wherein the steam is introduced both below the shed decks but above the stripped tailings pool and into the tailings pool.

9. The method of claim 6, wherein the tailings are injected in between the stack of shed decks and directly above the stack of shed decks.

10. The method as claimed in claim 5, wherein the steam is introduced into the stripped tailings pool.

11. The method of claim 5, wherein the tailings are introduced into the high pressure stripping vessel by injecting the tailings into the stripped tailings pool.

12. The method of claim 5, wherein a portion of high temperature stripped tailings from the stripped tailings pool is recycled back to the high pressure stripping vessel.

13. A method for recovering hydrocarbon diluent from tailings comprising bitumen, particulate solids, hydrocarbon diluent and water, the method comprising:

separating the tailings into a fine tailings slurry and a coarse tailings slurry;

introducing the fine tailings slurry into a first high pressure stripping vessel operating at a pressure greater than 100 kPa;

introducing a stripping gas into the first high pressure stripping vessel to strip the hydrocarbon diluent and water from the fine tailings slurry and form a stripped fine tailings pool at the bottom of the vessel;

introducing the coarse tailings slurry into a second high pressure stripping vessel operating at a pressure greater than 100 kPa; and introducing a stripping gas into the second high pressure stripping vessel to strip the hydrocarbon diluent and water from the coarse tailings slurry and form a stripped coarse tailings pool at the bottom of the vessel.

14. The method as claimed in claim 13, further comprising:

removing a portion of high temperature stripped fine tailings from the stripped fine tailings pool and a portion of high temperature stripped coarse tailings from the stripped coarse tailings pool; and introducing the portion of high temperature stripped fine tailings and the portion of high temperature stripped coarse tailings into a low pressure flash vessel operating at a pressure below 100 kPa to remove additional hydrocarbon diluent from the portions.

15. The method as claimed in claim 13, wherein the first high pressure stripping vessel comprises trays or packings and the second high pressure stripping vessel comprises shed decks.

* * * * *